United States Patent [19]

Lithwick

[11] Patent Number: 4,951,404

[45] Date of Patent: Aug. 28, 1990

[54] GREETING CARD OR THE LIKE

[76] Inventor: Stanley A. Lithwick, 10 Orrin Avenue, Ottawa, Ontario, Canada, K1Y 3X6

[21] Appl. No.: 190,193

[22] Filed: May 4, 1988

[30] Foreign Application Priority Data

Nov. 17, 1987 [CA] Canada ..... 551980

[51] Int. Cl.[5] ..... G09F 1/00

[52] U.S. Cl. ..... 40/124.1; 229/92.8; 206/462

[58] Field of Search ..... 40/124.1, 538; 229/92.8, 92.9; 206/472, 475, 461, 462

[56] References Cited

U.S. PATENT DOCUMENTS

| | | | |
|---|---|---|---|
| 1,011,697 | 12/1911 | Witkowski | 40/539 |
| 1,689,637 | 10/1928 | Mordecai | 40/538 |
| 1,714,774 | 5/1929 | Goldsmith | 206/475 |
| 2,246,622 | 6/1941 | Dennis | 206/472 |
| 2,256,399 | 9/1941 | MacHarg | 229/92.8 |
| 2,394,980 | 2/1946 | Byck | 40/124.1 |
| 3,307,281 | 3/1967 | Mateo | 229/92.8 |
| 3,664,049 | 5/1972 | Smith | 40/124.1 |
| 4,200,222 | 4/1980 | Fever | 229/92.8 |
| 4,430,843 | 2/1984 | Favale | 229/92.8 |
| 4,840,275 | 6/1989 | Faiola et al. | 206/462 |

FOREIGN PATENT DOCUMENTS

| | | | |
|---|---|---|---|
| 447892 | 4/1948 | Canada . | |
| 0070727 | 1/1983 | European Pat. Off. . | |
| 366415 | 5/1906 | France | 229/92.8 |
| 990036 | 5/1951 | France . | |
| 1217017 | 4/1960 | France | 40/124.1 |
| 1204801 | 9/1961 | France | 40/124.1 |
| 2422559 | 12/1979 | France | 229/71 |
| 480953 | 11/1969 | Switzerland . | |
| 2061821 | 5/1981 | United Kingdom . | |
| 2106034 | 4/1983 | United Kingdom . | |

*Primary Examiner*—Gene Mancene
*Assistant Examiner*—Michael Lynch
*Attorney, Agent, or Firm*—Sughrue, Mion, Zinn, Macpeak & Seas

[57] ABSTRACT

A greeting, display, or the like card is disclosed having a cutout in a front panel, the front panel being hingedly connected along a fold line to a rear panel. The cutout is filled with a transparent container capable of holding ornamental objects, usually thematically associated with an ornament displayed on the inner surface of the rear panel of the card. For instance, the ornament on the second panel may contain a picture of a tree with small hearts while the container itself may contain a few three-dimensional heart-like objects as if they were the fruits of the tree. The invention provides a further enhancement of attractiveness of greeting cards by securing a transparent container which may include an additional ornamental subject.

7 Claims, 5 Drawing Sheets

GREETING CARD OR THE LIKE

The present invention relates to the art of ornamental greeting cards particularly to greeting cards which include two panels hinged to each other along a fold line and comprising a cutout or window in a front panel.

The art of production of greeting cards belongs to highly competitive industries. The manufacturers of greeting cards constantly strive to improve both the quality and the visual appeal to the customers. The enhancement of the visual appeal of a greeting card is known to have been attempted in several ways among which an attractive ornamentation of one or both of the panels of the greeting card is the most common approach. It is also known to provide greeting cards which have cutouts or windows in their front panel for displaying ornamental features or information placed on the rear panel of the card.

It is an object of the present invention to provide a greeting card which would have additional appeal to the eye of the user.

In general terms, the present invention provides a greeting, display or the like card comprising, in combination, a first panel having an outer face and an inner face, a second panel having an outer face and an inner face, said panels being hinged to each other along a common edge; a container fixedly secured to the first panel and having a transparent surface, said container being so arranged that at least a part of the inner face of the second panel is visible through said transparent surface when viewing at least one of the faces of the first panel.

In a particularly preferred embodiment, the width and the height of the container is substantially greater than its thickness to reduce the visual impact of a great thickness of the container as compared with the thickness of the first panel. In a particularly preferred embodiment, the transparent container houses at least one, preferably more, ornamental objects the size of which is such that a part of the portion of the second panel is visible through the container when the card is in said folded state. This enables the use of the present invention for placing into the container small objects which may be thematically related to the ornament of the second panel, which ornament is visible through the container when the card is in its folded state.

The present invention will now be described in greater detail by way of an example, with reference to the accompanying drawings, wherein.

Figure 1:
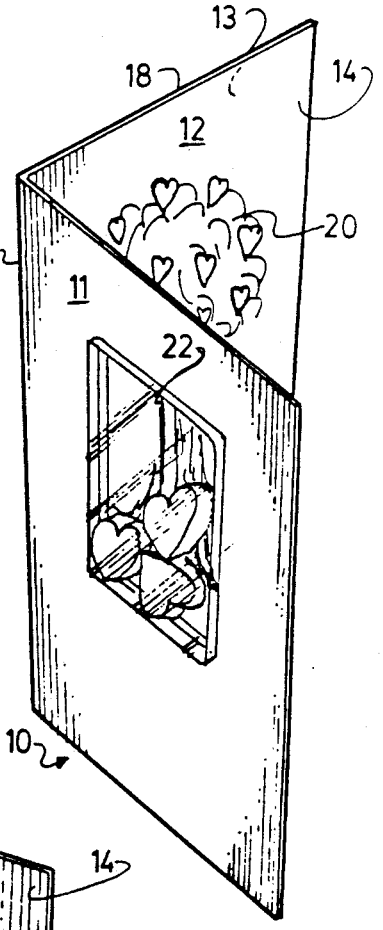
FIG. 1 shows a typical arrangement of a preferred embodiment of the card in a perspective view, showing inner faces of the two panels.

The greeting card 10 of the present invention generally comprises two panels of which panel 11 is referred to as "a first panel" and panel 12 as a "second panel". For the sake of clarity, each face of panels 11 and 12 has its own designation. Thus, the outer face of panel 12 is designated with reference numeral 13. The inner face of the same panel 12 is designated with reference numeral 14. Similarly, the first panel 11 has an outer face 15 and an inner face 16.

The two panels 11 and 12 are prOduced from a rectangular sheet 17 (FIG. 8) by folding the sheet 17 along a first fold line 18 and then along a second fold line 19 . The second fold line 19 eventually coincides with the line of hinged securement of panels 11 and 12 to each other along a common edge, the edge being actually formed by the fold line 19. The second panel 12 is provided with an motif 20 which, in the shown embodiment, is a coloured picture of a tree showing a number of heart-shaped fruits therein.

The front panel 11 is provided with a cut-out 21 within which is fixedly secured a flat container 22 produced from a transparent thin sheet acrylic having the thickness of about 0.3 mm.

Within the container 22 is displayed a number, in the shown embodiment three, heart-shaped objects 23 whose shape is similar to the shape of the heart-like fruits displayed in the ornament 20. Thus the objects 23 and the representation in the ornament 20 have a common theme. It is best seen from FIGS. 1 and 2 that both faces of the container 22 are transparent so that, with the card 10 folded, at least a part of the ornament 20 on the inner face 14 of the second panel 12 is visible through the container 22. The container 22 thus performs the function of a window as well as that of a container.

Figure 2:
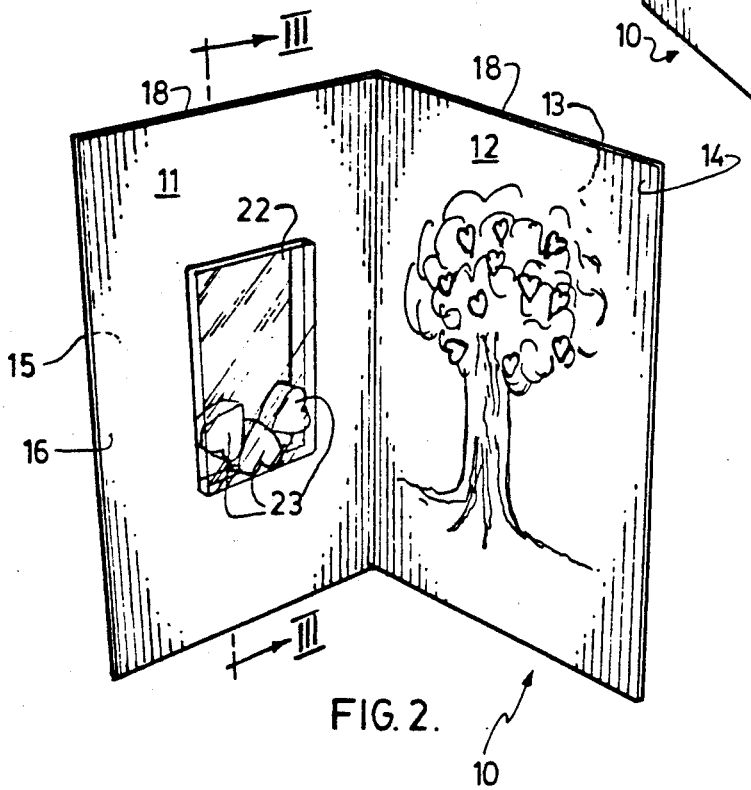
FIG. 2 is a perspective view showing the card when viewed from the outer face of the first panel thereof.
Figure 3:
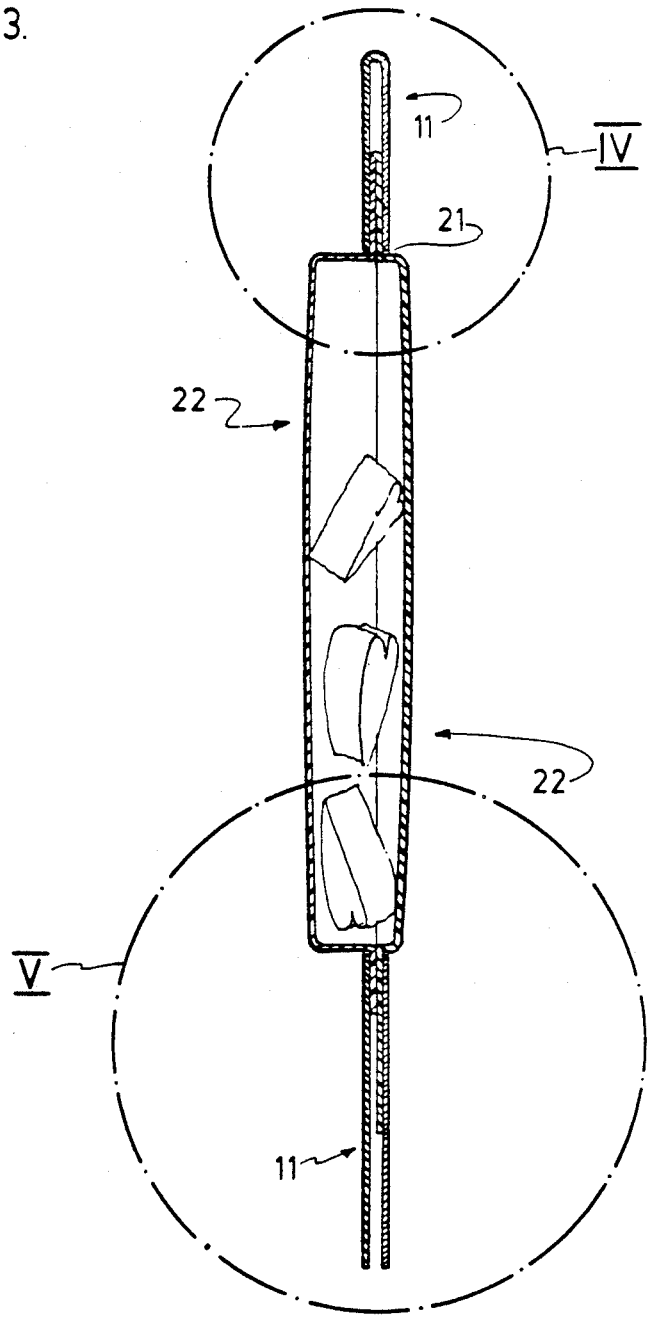
FIG. 3 is an enlarged, not-to-scale section III—III of FIG. 1.
Figure 4:
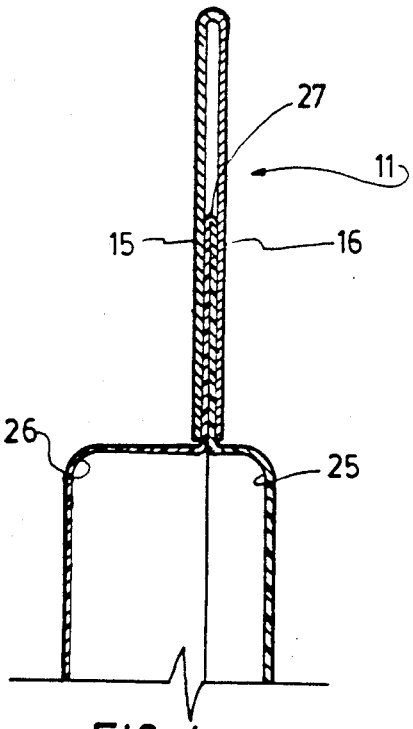
FIG. 4 is detail IV of FIG. 3.
Figure 5:
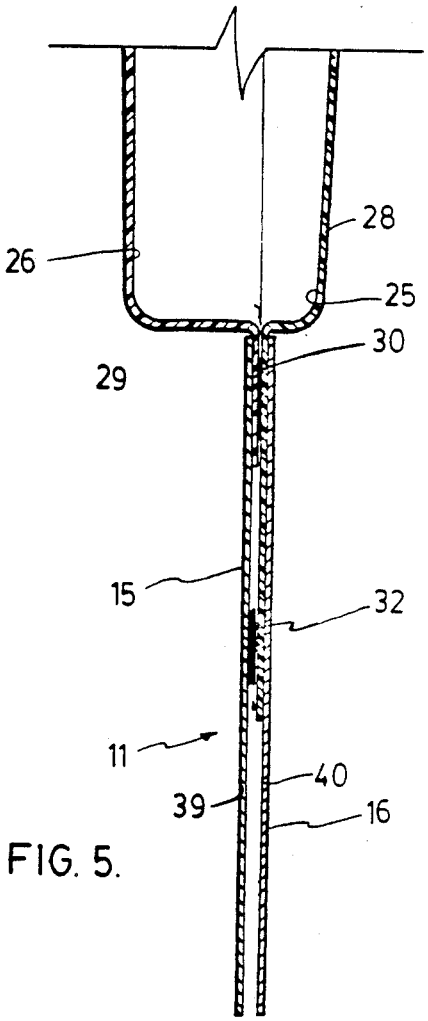
FIG. 5 is detail V of FIG. 3.

The manufacture of the greeting card as shown in FIGS. 1 and 2 can be carried out in many different ways. As an example, the container 22 is produced from a molded sheet of acrylic as referred to above, the sheet being designated in FIG. 6 with reference number 24. The sheet 24 is stamped out of a flat material and has molded therein a first tray-like cavity 25 and a second tray-like cavity 26. The tray-like cavities 25 and 26 can also be referred to as "a shallow cavity 25" and "a deep cavity 26", respectively. The regions within which the cavities 25 and 26 appear are separated from each other by a fold line 27 subdividing the two segments of the sheet 24 into an inner panel 28 and an outer panel 29. The inner panel 28 is provided, on its top surface as viewed in FIG. 6, with a two-sided adhesive tape 30, one side of which is adhered to the top surface of the inner panel 28 and the other is covered by a backing tape 31. A similar two sided tape 32 is provided at the free end of the inner panel 28. The T-shaped stamping of the acrylic panel as shown in FIG. 6 provides, in the area of its outer panel 29, two side tabs, each provided with a two-sided adhesive tape 33, 34.

Figure 6:
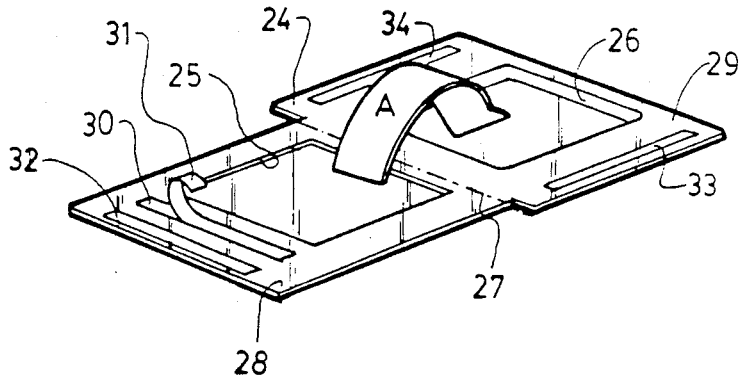
FIGS. 6–10 are simplified perspective views showing the sequence of one way of producing the card of the present invention.
Figure 7:
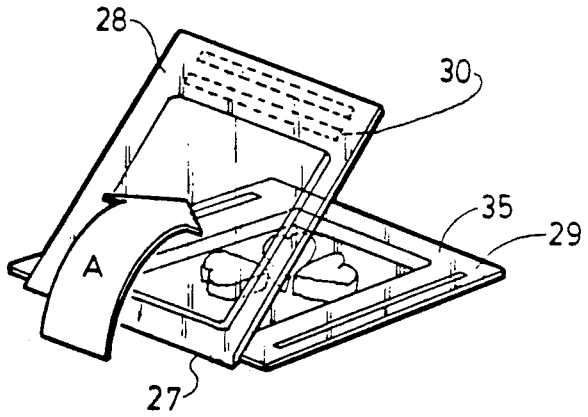
Figure 8:
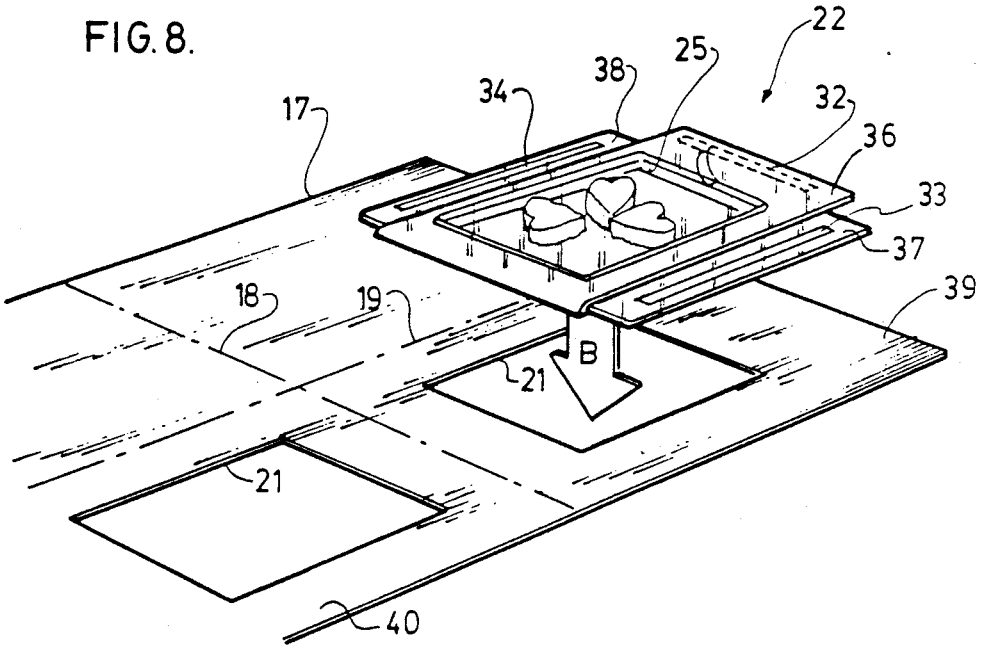
Figure 9:
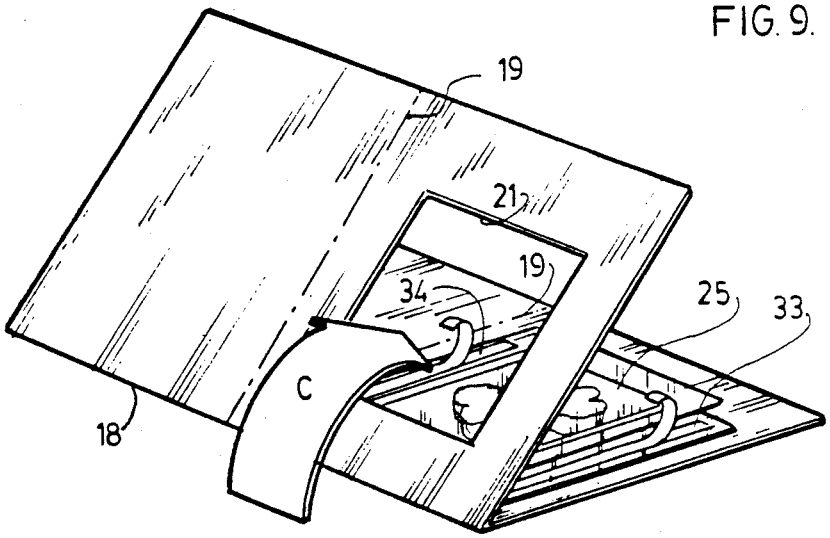
Figure 10:
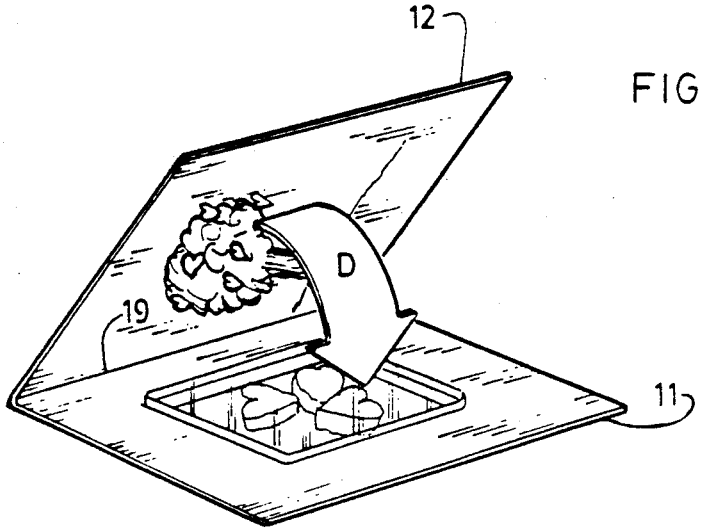

After removal of the backing tape 31, the inner panel 28 is folded over the outer panel 29, (arrow A) whereupon the now exposed adhesive top surface of tape 30 (as seen in FIG. 6) adheres to the free end tab 35 of the outer panel 29. The two cavities 26 and 27 now combine to form the container. In the fully folded state shown in FIG. 8, there are three tabs 36, 37 and 38. One of the three tabs, the tab 36, is at one end of the container and one of each of the remaining tabs 37, 38 is at the respective side of the rectangular container. Viewing the arrangement in FIG. 8, the two sided tape 32 is now on the underside of tab 36 while the tapes 33 and 34 are on top of their respective tabs 37, 38. When the thus assembled container is placed (arrow B) into the complementary cutout 21, the adhesive tape 32 adhesively secures the top surface of segment 39, formed by fold lines 18, 19, to the tab 35. As shown in FIG. 9, the backing tapes of the two-sided adhesive tapes 33 and 34 are now removed, whereupon the sheet 17 is folded along the folding line 18 to bring a second segment 40 formed by lines 18, 19, into adhesive contact with the tapes 33 and 34 and thus with the side-tabs of the container and, via the tab 35 and the tape 32, to the first mentioned segment 39—to form the first panel 11. The second part of the cutout 21, located in the second segment 40, matches the contour of the shallow depression 25 which is shown in FIG. 8 and in FIG. 9 as protruding upwardly. When the folding along the fold line 18 in the direction of the arrow C in FIG. 9 is completed, the only step remaining is to complete the product by folding the assembly about line 19, in the direction of the arrow D in FIG. 10. The product is now finished and is ready to be placed in a special envelope which can have further ornamental features and not forming part of the present invention.

It can be seen on review of the drawings that the shallow cavity 25 is disposed at the inner face of the first panel 11, while the deeper cavity 26 is disposed at the outer face of the panel 11.

This is of advantage in that the container provides, on the one hand, sufficient depth or thickness for receiving three-dimensional ornamental objects such as small heart-shaped articles, while allowing a generally complete closing of the card as is usual in other greeting cards. When fully closed, the container 22 forms, on the one hand, a window through which a part of the ornament 20 is visible while, on the other hand, it also serves the purpose of holding additional ornamental articles.

The invention can be practised in a vast number of different combinations each of which may render the greeting card attractive to a particular group of consumers. For instance, the representation of the tree in the ornament 20 may be replaced by that of a house while the container may be provided with a flat picture of a cat which, on closing the card, may appear to be sitting on a driveway of the house or the like.

Those skilled in the art will appreciate that a number of shapes and different arrangements of the present invention can be used departing from the embodiment described. For instance, it is not absolutely vital that the container be transparent at each face thereof even though such embodiment is clearly preferred. The shape of the container and the configuration of its faces are also optional. The way of manufacturing the card and its components can be modified to a very substantial degree.

Accordingly, I wish to secure by a patent which may issue on the present application a protection the scope of which is commensurate with my contribution to the art.

The embodiments of the invention in which an exclusive property or privilege is claimed are defined as follows:

1. A greeting, display or the like card comprising, in combination, a first panel having an outer face and an inner face, a second panel having an outer face and an inner face, said panels being hinged to each other; and a container generally integral with the first panel and having transparent opposing surfaces, said transparent opposing surfaces being so arranged that the interior of the container is visible through said transparent surfaces when viewing either one of the faces of the first panel; and wherein a portion of the inner face of the second panel which is overlapped by the container when the greeting card is in a folded state, is visible through the container when viewing the outer face of the first panel in a direction generally perpendicular to the first panel, said second panel displaying a motif on said inner face thereof, the motif being disposed at a part of the inner face of the second panel which is overlapped by said container when the two panels are in a closed, overlapping state.

2. A greeting, display or the like card comprising, in combination, a first panel having an outer face and an inner face, a second panel having an outer face and an inner face, said panels being hinged to each other; and a container generally integral with the first panel and having transparent opposing surfaces, said opposing surfaces being so arranged that the interior of the container is visible through one of said transparent surfaces when viewing either one of the faces of the first panel; and wherein a portion of the inner face of the second panel which is overlapped by the container when the greeting card is in a folded state, is visible through the container when viewing the outer face of the first panel in a direction generally perpendicular to the first panel, the container containing one or more ornamental objects the size of which objects is such that at least a part of said portion of the inner face of the second panel is visible through the container.

3. A greeting card as claimed in claim 1 or claim 2, wherein the first panel is generally planar and wherein the transparent surfaces are generally flat and parallel with the plane of the first panel.

4. A greeting card as claimed in claim 1 or claim 2, wherein the first panel is generally planar and wherein one of said transparent surfaces is generally flat and parallel with the plane of the first panel, said one transparent surface being spaced outwardly of the outer face of the first panel.

5. A greeting card as claimed in claim 1 or claim 2, wherein the first panel is generally planar and wherein one of said transparent surfaces is generally flat and parallel with the plane of the first panel, said one transparent surface being spaced inwardly of the inner face of the first panel.

6. A greeting card as claimed in claim 1 or claim 2, wherein the first panel is generally planar and wherein a first of said transparent surfaces is generally flat and parallel with the plane of the first panel, said first transparent surface being spaced outwardly of the outer face of the first panel, a second transparent surface being spaced inwardly of the inner surface of the first panel.

7. A greeting card as claimed in claim 1 or claim 2, wherein the width and the height of the container is substantially greater than its thickness.

* * * * *